US005313749A

United States Patent [19]

Conner

[11] Patent Number: 5,313,749

[45] Date of Patent: May 24, 1994

[54] REINFORCED STEEL BEAM AND GIRDER

[76] Inventor: Mitchel A. Conner, 3220 Stonehenge Dr., St. Charles, Mo. 63303

[21] Appl. No.: 875,628

[22] Filed: Apr. 28, 1992

[51] Int. Cl.[5] ..... F04C 3/10

[52] U.S. Cl. ..... 52/223.12; 52/223.8; 52/223.13; 52/223.14; 52/729

[58] Field of Search ..... 52/223.1, 223.11, 223.13, 52/223.14, 223.8, 223.9, 741.1, 223.12, 729, 650.1

[56] References Cited

U.S. PATENT DOCUMENTS

| | | | |
|---|---|---|---|
| 2,075,633 | 3/1937 | Anderegg | 52/223.9 |
| 2,510,958 | 6/1950 | Coff | 52/223.8 |
| 3,010,257 | 11/1961 | Naillon | 52/223.9 |
| 3,140,764 | 7/1964 | Cheskin | 52/223.12 |
| 3,341,995 | 9/1967 | Docken | 52/223.13 |
| 3,427,773 | 2/1969 | Kendall . | |
| 3,810,337 | 5/1974 | Pollard | 52/223.8 |
| 3,835,607 | 9/1974 | Raaber | 52/223.8 |
| 3,942,238 | 3/1976 | Dore . | |
| 4,006,523 | 2/1977 | Mauguoy . | |
| 4,185,440 | 1/1980 | Finsterwalder . | |
| 4,275,537 | 6/1981 | Pinson | 52/223.8 |
| 4,393,637 | 7/1983 | Mosier | 52/223.8 |
| 4,398,377 | 8/1983 | Romig, Jr. . | |
| 4,604,003 | 8/1986 | Francoeur et al. | 52/223.13 |
| 4,831,800 | 5/1989 | Nedelcu . | |
| 4,965,973 | 10/1990 | Engebretsen . | |

*Primary Examiner*—Michael Safavi

*Attorney, Agent, or Firm*—Polster, Lieder, Woodruff & Lucchesi

[57] ABSTRACT

A steel beam is reinforced by an attachment which creates a moment to counteract loads placed on the beam when it is incorporated into a structure. The attachment includes a transmitting member which is secured to the underside of the beam and a tensioned cable which is carried, in a tensioned state, by the transmitting member. The tensioned cable compresses the transmitting member creating an upward moment which is transmitted to the beam.

1 Claim, 3 Drawing Sheets

REINFORCED STEEL BEAM AND GIRDER

BACKGROUND OF THE INVENTION

This invention relates to reinforced steel beams used in the construction of buildings and bridges.

Buildings and bridges are commonly made of steel beams and girders upon which a floor or road surface is laid. The beams and girders are selected from standard rolled sections. Or, they are designed to have enough material in the compression and tension flanges to resist the stress of the load (bending) moment, with an acceptable amount of deflection in the beam at the location of the maximum moment. When a load is placed upon the floor or road surface, the load creates a downward or bending moment which bends the steel beams downwardly. The downward moment places the top of the beam in compression and the bottom of the beam under tension. This load may ultimately cause the beams to fail at some point in the future. By compressing the bottom of the beam, the designer is able to counter-act and reduce the bending effect of the load moment, which will also reduce the horizontal shear in a loaded beam or girder. Counter-acting the load (bending) moment may also aid in the beam's ability to resist the effects of, for example, an earthquake. The life of the beams and the load they can carry can thus be increased by reinforcing the beam so as to produce an upward, or counter, moment in the beam, to counteract the downward moment created by the load placed on the beam.

Various methods have been used to reinforce steel beams. One method of reinforcing beams, such as I-beams or T-beams, involves securing steel plates to the beam. This provides the extra strength to the beam; however, it increases the weight of the beam. The steel content of a building is one of its most costly components. Thus, the extra steel used in the construction of buildings using this method drastically increases the cost of the building.

Mauquoy U.S. Pat. No. 4,006,523 describes a method of pre-stressing a steel beam that avoids the use of plating the beam. Mauquoy secures a plurality of varying length transmission elements to the bottom of the beam. Guides and wires are then secured to the transmission elements. The wires extend around the guides. The wires are then stressed to provide an upward moment to the beam to counteract the load. However, before the wires are stressed, supports are placed above and below the beam to compress the beam, to induce an upward moment in the beam. The wires are then tensioned, and the wires, transmission elements, and guides are then encased in concrete to hold the tension in the wires. Mauquoy's method requires special machinery to provide the upward moment to the beam. The beams cannot, thus, be reinforced on the building site. Further, the concrete adds a great amount of weight to the beam. This, again, significantly increases the ultimate weight of the building, and significantly adds to its construction cost.

Kandall U.S. Pat. No. 3,427,773 discloses a method of pre-stressing a beam which does not use concrete. Kandall teaches pre-stressing the beam by securing stiffener plates to the vertical web of the beam and then anchoring a cable or tendon to the beam along its vertical web. Kandall secures the cable to the beam at several locations so the cable lies along a polygonal line. Kandall's construction requires extra steel to produce the stiffeners. Further, because the stiffeners extend the length of the beam's vertical web, holes must be drilled therethrough to allow the cable to pass from one end of the beam to the other. This reinforcing system also causes substantial interference with the framing of other beams into the beam being reinforced. Kandall's method further adds significant weight to the beam and is complex and costly to use.

SUMMARY OF THE INVENTION

One object of this invention is to provide reinforced steel beams for use in the construction of buildings and bridges.

Another object is to provide such a reinforced beam which will not add significant weight to a building.

Another object is to provide such a reinforced beam which is economical to produce.

Another object is to provide such a reinforced beam which may be easily produced at a construction site.

Another object is to provide a method of reinforcing beams prior to their use in a construction project.

Another object is to provide such a method which may also be used to reinforce the steel beams of an existing structure.

These and other objects will become apparent to those skilled in the art in light of the following disclosure and accompanying figures.

In accordance with the invention, generally stated, a reinforced steel beam for use in building structures comprises a steel structural beam, a transmitting member secured to the beam which transmits an upwardly directed moment to the beam, and a tensioned member carried by the transmitting member. The tensioned member is substantially parallel to the beam's longitudinal axis, and creates the upwardly directed moment. The tensioned member is made of at least one tensioned cable or rod, and extends through the transmitting member. Compression plates are held against the ends of the transmitting member. The ends of the tensioned member are secured to the compression plates. The tensioned member preferably extends through holes in the plates and are held in place against outer surfaces of the plates by tension locks.

In one embodiment, the transmitting member is a single hollow tube which extends substantially the full length of said beam. The tensioned member extends through the tube.

In a second embodiment, the transmitting member includes a first and a second transmitting element, each of which has at least one longitudinal bore through which the tensioned member extends. Each of the transmitting elements are substantially shorter than the length of the beam and are spaced apart to be secured near the ends of the beam. The transmitting member may also be a T-member or a substantially U-shaped or box-shaped member.

The tensioned cable pulls the compression plates together to place the transmitting member in compression. Because the transmitting member is secured to the beam along its length, the compression of the transmitting member is transmitted to the beam. This places the bottom of the beam in compression and creates an upward moment which counter-acts the bending moment created by the load. A method of reinforcing a beam is also disclosed. Because this method does not add extraneous steel or cement to the beam, it does not add unnecessary weight to the beam. Thus, using the method disclosed, the weight of the building can be reduced, while increasing the load carrying capacity of the beam or the length it can span without exceeding acceptable deflection or bending limits.

DESCRIPTION OF THE PREFERRED EMBODIMENT

Figure 1:
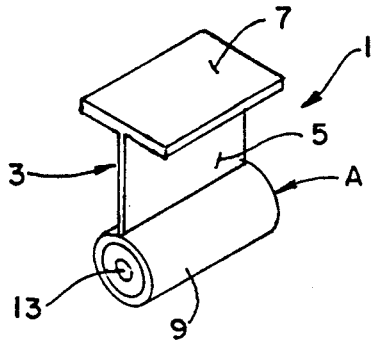
FIG. 1 is a perspective view of a reinforced beam of the present invention.
Figure 3:
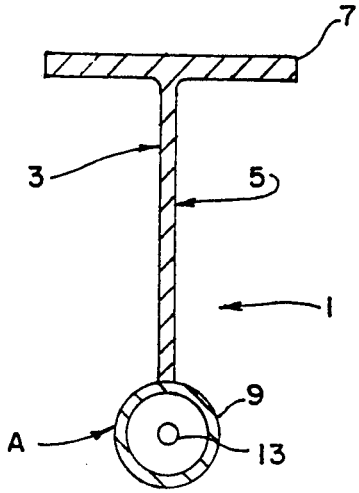
FIG. 3 is a cross-sectional view taken along line 3—3 of FIG. 2.
Figure 2:
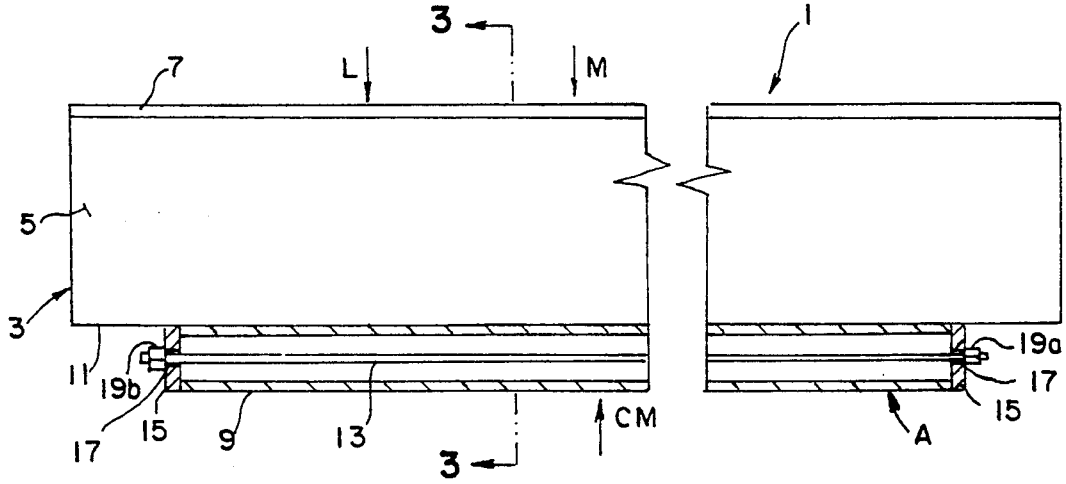
FIG. 2 is a side elevational view, partly in cross section, of the reinforced beam.

A reinforced steel beam 1 is shown in FIGS. 1-3. Beam 1 consists of a steel T-beam 3, which is important in structures in which dust and contaminate accumulation on the bottom flange of an I-beam is undesirable. Although a T-beam is used, it will be apparent that an I-beam may also be used. Beam 3 has a stem 5 and a top flange 7. When a load, shown by arrow L, is placed on beam 3, it creates a downward or bending moment M. Moment M bends or flexes beam 3 and causes flange 7 to be compressed and the free end 11 of stem 5 to be stretched or tensioned. To overcome moment M, an attachment A is secured to stem 5 to produce an upward, or counter, moment CM in beam 3.

Attachment A includes a steel tube 9 welded to free end 11 of stem 5. Although tube 9 is shown as circular in cross-section, it may have any cross-sectional shape. Tube 9 is substantially parallel with flange 7 and the longitudinal axis of beam 3. The tube is welded to beam 3 over the tube's entire length so that, under loaded conditions, beam 3 and tube 9 will act together as one unit. Tube 9 is somewhat shorter than beam 3 to provide clearance for framing members of a building, space for steel industry standard framing connections, and clearance to allow for tensioning of the beam, as is described below.

Tube 9 carries one or more high strength tensioned rods or cables 13 located with reference to the tube's centroid. Cables 13 run parallel to the longitudinal axis of beam 3. Bearing plates 15 are placed at either end of tube 9 to cover the entire ends of tube 9. Cable 13 is longer than tube 9 and extends through bores 17 formed in plates 15. The ends of the cable are held in place by locking devices 19*a* and 19*b* positioned on outer surfaces of plates 15. Locking devices 19*a* and 19*b* may be threaded nuts or wedges which will hold the cable in place under tension.

Figure 4:
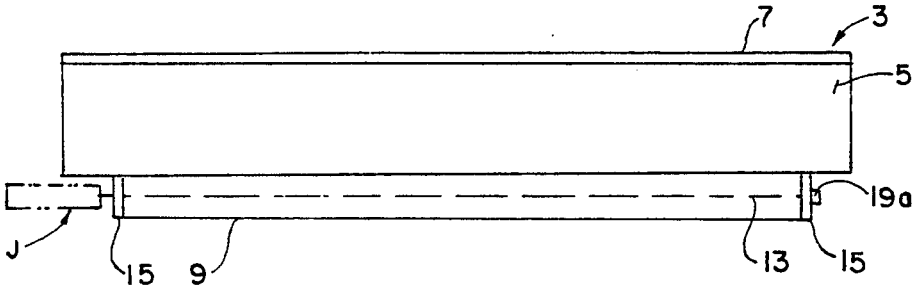
FIG. 4 is a side elevational view of the beam, diagramatically showing the tensioning of a cable.

Referring to FIG. 4, counter-moment CM is created by securing one end of cable 13 to one of the plates 15 by locking device 19*a*. The other end of cable 13 is attached to a hydraulic jack J, after it has been threaded through hole 17 of its compression plate 15, and through locking device 19*b*. Using jack J, cable 13 is stretched until a predetermined tensile force, equal to all or part of the tension which is formed in free end 11 by moment M, is produced. The magnitude of the stress in the tension rods or cables 13 is determined by calculating the load moment in an existing beam or girder under its loaded condition. The end of cable 13 held by the jack is then locked in place by locking device 19*b*. Cable 13 can be tensioned in tube 9, before or after beam 1 is installed in a structure. It will be apparent that a winch, rather than jack J, could be used to tension cable 13.

Locking devices 19*a* and 19*b* lock cable 13 in its stressed condition. Because locking devices 19*a* and 19*b* are external of plates 15, plates 15 are pulled toward each other. This compresses tube 9. Bearing plates 15 transmit the compressive force of the tension rods, or cables 13, uniformly to tube 9, creating upward moment CM in the tube. Because tube 9 and beam 3 act together, moment CM will be transferred to beam 3, to counteract the loads that will be placed on the beam. Tube 9 therefore acts as a transmitting member to transmit the moment CM to beam 3. This enables the structure to carry greater loads, to reduce the number of beams which make up a floor, or to lengthen the span a beam can cover.

Figure 5:
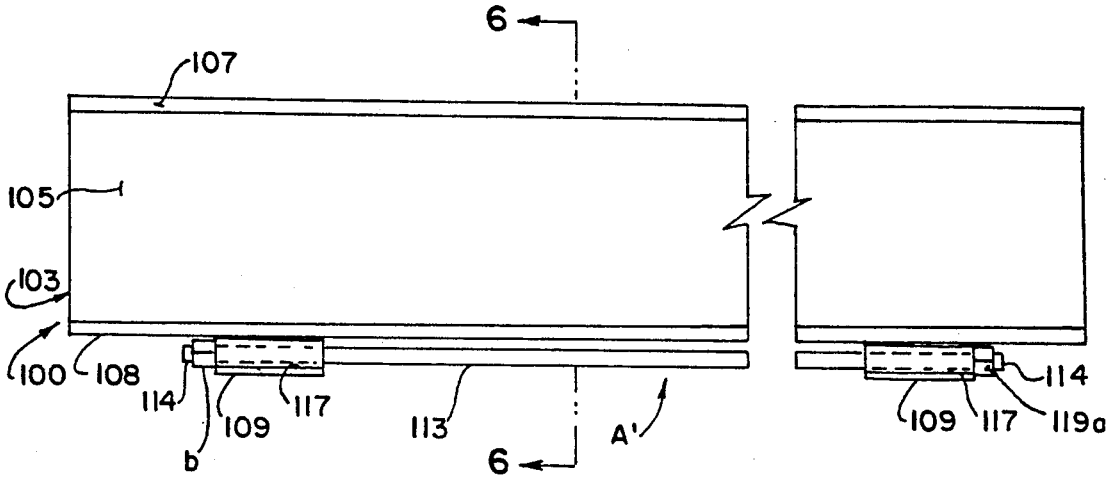
FIG. 5 is a side elevational view of another embodiment of a reinforced beam.
Figure 6:
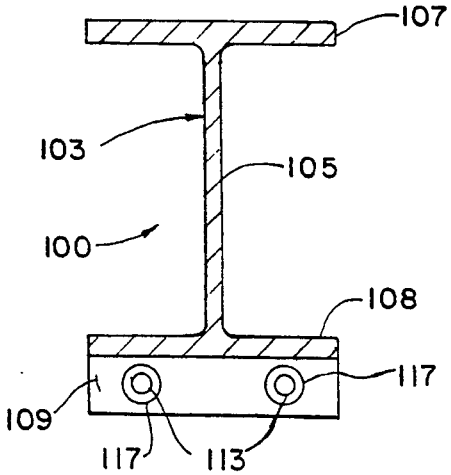
FIG. 6 is a cross-sectional view taken along line 6—6 of FIG. 5.

Another embodiment of a reinforced beam 100 is shown in FIGS. 5-6. As will be explained, this embodiment will be of particular value in upgrading the structural integrity and load carrying capacity of steel beams used in existing structures. This variation of the counter-moment attachment A can be used to increase the load carrying capacity of steel beams and girders. It may also be used to improve the structure's earthquake resistance ability.

Reinforced beam 100 consists of an I-beam 103 having a web 105, a top flange 107, and a bottom flange 108. When load L is placed on beam 103, flange 107 is compressed and flange 108 is tensioned. Attachment A' is secured to flange 108 to induce counter-moment CM.

Attachment A' includes bearing blocks 109 which are welded to bottom flange 108 near the ends thereof. Bearing blocks 109 are blocks of steel or fabricated steel weldments which are welded to flange 108. Blocks 109 have longitudinally extending bores 117. Blocks 109 carry one or more tension rods or cables 113 which are parallel to the longitudinal axis of beam 103. Cables 113 are sufficiently long so that terminal ends 114 of rods or cables 113 pass through and beyond holes 117. Cables 113 are secured in place by threaded locking nuts or wedges 119*a* and 119*b*, in the same manner that cables 13 are secured in place.

With the use of a hydraulic tensioning jack, the rods or cables are stretched to the pre-determined tensile force, in the same manner that cable 13 is stretched. The rods or cables are locked in their tensioned state by installing the locking devices 119*a* and 119*b* which bear against outer surfaces of blocks 109 to produce counter-moment CM in beam 103.

Figure 7:
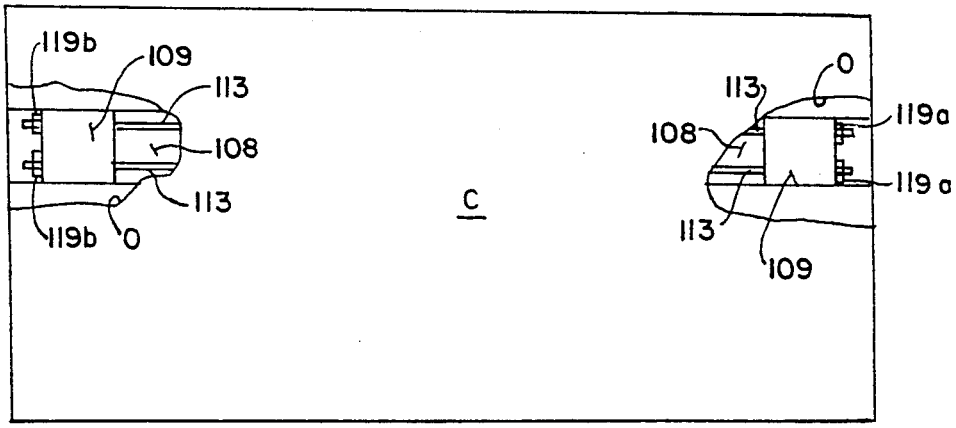
FIG. 7 is a plan view of a ceiling of a building broken away to expose its structural beams to reinforce beams after they have been incorporated in an existing building.

Because there is no tube, such as tube 9, which extends nearly the entire length of beam 103, this embodiment may be used to create a counter-moment in a steel beam already placed in an existing structure. All that is required is that openings O in a ceiling C be made to expose the ends of the beam. (See FIG. 7) Bearing blocks 109 may thus be welded to the beam, and the cable can be snaked along the bottom of the beam to be locked to blocks 109. One end of the cable is secured with a nut or wedge 119*a* on the outside of one bearing block, and the other end is secured to a hydraulic jack, which is used to stretch cable 113. When properly stretched or tensioned, the other end of cable 113 is secured with a nut or wedge 119*b*.

Figure 8:
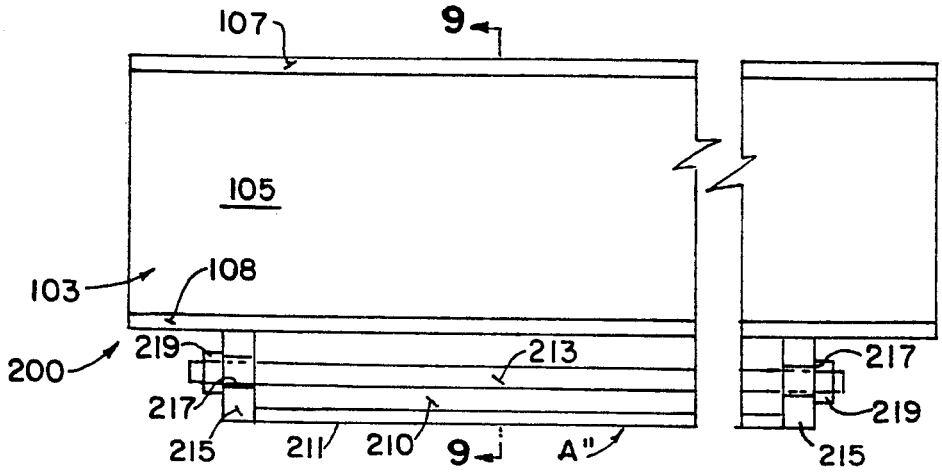
FIG. 8 is a side elevational view of a third embodiment of a reinforced beam.
Figure 9:
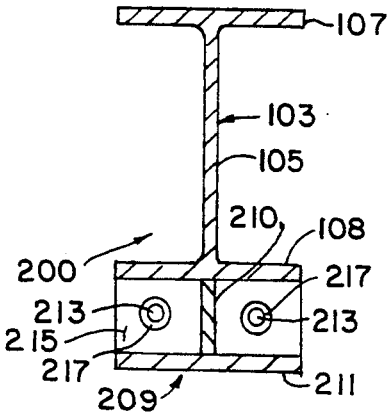
FIG. 9 is a cross-sectional view taken along line 9—9 of FIG. 8.

In FIGS. 8–9, a third embodiment is shown in which a counter-moment attachment A" is used to make a reinforced beam 200. Reinforced beam 200 may be used to increase the load carrying capacity or span capability of standard mill rolled structural steel sections, such as I-beams like beam 103.

The counter-moment attachment A" includes an upturned T-section 209 having a stem 210 and a flange 211. T-section 209 is welded to flange 108 of beam 103 such that stem 210 is co-linear with, i.e. an extension of, beam web 105. The weld preferably extends the full length of T-section 209 so that T-section 209 and beam 103 act together when under load. Flange 211 of T-section 209 is parallel to flange 108. T-section 209 extends nearly the full length of beam flange 108. The ends of T-section 209 are spaced from the ends of beam 103 a sufficient distance to accommodate clearance with other framing members.

Compression bearing plates 215 having holes 217 are placed against the ends of T-section 209 and cover the entire end of the T-section 209. Plates 215 are preferably welded to beam tension flange 108. One or more high tensile rods or cables 213 are installed on each side of stem 210 between beam flange 108 and T-section flange 211. Tension rods or cables 213 pass through holes 217 in the bearing plates; and, after they are tensioned, are locked into a stressed condition by locking wedges or threaded nuts 219 against the bearing plates. Cables 213 thus create a compression force which pulls plates 215 toward each other. The bearing plates transmit the compression force produced by tensioned cables 213 to T-section 209 and thus to beam 103 as an upward moment CM to counter-act the downward or bending moment M produced by loads placed on beam 103.

Figure 11:
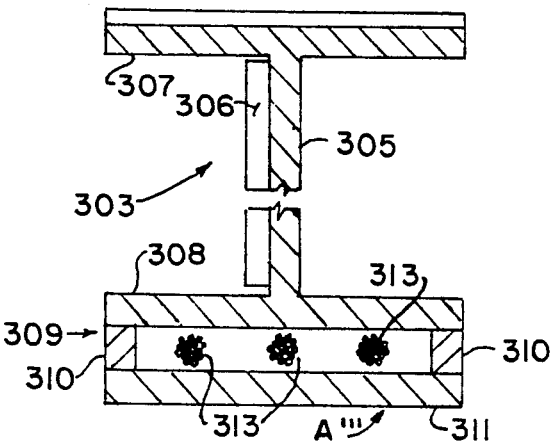
FIG. 11 is a cross-sectional view taken along line 11—11 of FIG. 10.
Figure 10:
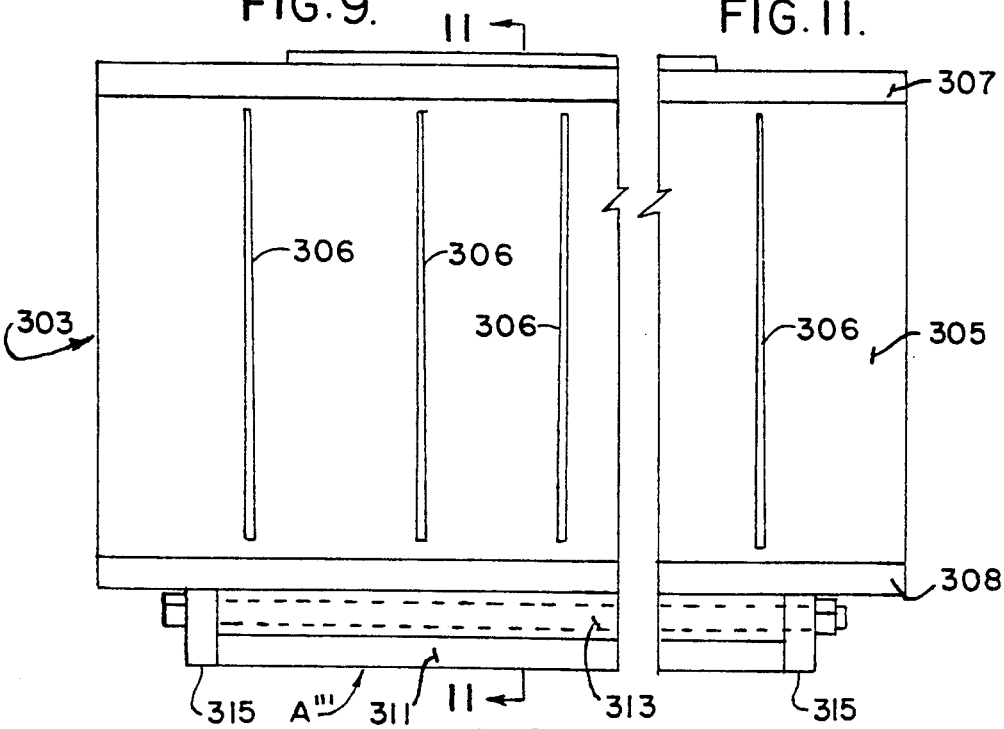
FIG. 10 is a side elevational view of a forth embodiment of a reinforced beam.

In FIGS. 10–11, a fourth embodiment of a counter-moment producing attachment A''' is shown coupled with the design of heavy built-up plate girders 303, to decrease the weight of material and increase the span capability of plate girders 303. Plate girder 303 has a web 305, a top flange 307, a bottom flange 308, and a plurality of members 306 vertically secured to web 305. Members 306 extend nearly the full length of web 305 and a spaced from flanges 307 and 308.

Counter-moment attachment A''' includes an open box 309 having sides 310 extending upwardly from a bottom 311. Sides 310 may be integral with bottom 311 or may be separate pieces welded thereto. Sides 310 are welded to beam flange 308 so as to be flush with its sides. Bearing plates 315 are placed over each end of box 309 to fully cover its ends. Plates 315 have bores 317 extending therethrough. One or more high tensile rods or cables 313 (three bundles of cables are shown in FIG. 11) extend the entire length of the interior of box 309, and extend through bearing plate holes 317. With the use of hydraulic tensioning jacks the tension rods or cables 313 are stretched to a pre-determined tensile force and are then anchored to the bearing plates by locking wedges or threaded nuts 319, in the same manner described above with respect to cable 13. This procedure will impart to the tension flange 308 a pre-loaded compression force which will counter-act the load moment M.

By designing and fabricating standard steel T-beams, tubes, or beam and girder sections with counter-moment attachments, a given beam can carry greater loads or have longer spans within acceptable deflection limits. By utilizing this invention, the designer will be able to reduce the weight and amount of material conventionally required for a building or bridge and thereby improve the efficiency of structural steel members and reduce the cost of the project.

As numerous changes may be made to the preferred embodiments of the invention as disclosed above without departing from the spirit and scope of the invention, the scope of the invention is described solely by the following claims.

What is claimed is:

1. A reinforced steel beam for use in building structures comprising:

a steel structural beam; and, an attachment secured to said beam for transmitting an upwardly directed moment to said beam, the attachment including a first and a second transmitting member each comprising a T-member, each having at least one longitudinal bore therethrough, each said transmitting member being substantially shorter than the length of said beam; said transmitting members being spaced apart and secured to said beam near the ends thereof;

a first compression plate held against a first end of said transmitting member and a second compression plate held against a second end of said transmitting member;

and a tensioned member carried by said transmitting member and extending through said attachment and through said longitudinal bores, said tensioned member being secured to said compression plates, said tensioned member being substantially parallel to and below said beam's longitudinal axis, whereby said tensioned member creates said upwardly directed moment.

* * * * *